United States Patent [19]

Prinz

[11] Patent Number: 4,738,465

[45] Date of Patent: Apr. 19, 1988

[54] SINGLE SKI APPARATUS WITH REMOVABLE MINISKI

[76] Inventor: Klaus D. Prinz, 251 Longview Rd., Union, N.J. 07083

[21] Appl. No.: 846,114

[22] Filed: Mar. 31, 1986

[51] Int. Cl.[4] ..... A63C 5/00

[52] U.S. Cl. ..... 280/607; 280/618

[58] Field of Search ..... 280/607, 611, 617, 618, 280/809

[56] References Cited

U.S. PATENT DOCUMENTS

| | | | |
|---|---|---|---|
| 2,154,019 | 4/1939 | Westphal | 280/611 |
| 3,685,846 | 8/1972 | Schmid | 280/607 |
| 3,802,714 | 4/1974 | Freegard | 280/607 |
| 3,854,738 | 12/1974 | Fish | 280/607 |
| 3,934,893 | 1/1976 | Greenleaf | 280/611 |
| 3,944,237 | 3/1976 | Teague, Jr. | 280/618 |
| 4,003,587 | 1/1977 | Salomon | 280/618 |
| 4,008,908 | 2/1977 | Pierson | 280/607 X |
| 4,022,491 | 5/1977 | Powell | 280/607 X |
| 4,188,046 | 2/1980 | Fleckenstein | 280/618 |

*Primary Examiner*—David M. Mitchell
*Assistant Examiner*—Michael Mar
*Attorney, Agent, or Firm*—John G. Gilfillan III; Norbert Ederer

[57] ABSTRACT

A single ski apparatus is provided with a miniski, in addition to the single ski. The miniski is removably supported on an elevated platform which is atop a structure, the bottom of which is mounted on the single ski.

13 Claims, 5 Drawing Sheets

14

SINGLE SKI APPARATUS WITH REMOVABLE MINISKI

BACKGROUND OF THE INVENTION

1. Field Of The Invention

This invention relates to an apparatus for the sport of skiing. More particularly, this invention relates to an improved apparatus for skiing with a single ski.

2. Description Of The Prior Art

In an effort to get greater pleasure from the sport of skiing, ski enthusiasts have developed various kinds of equipment which can vary radically from the conventional pair of skis used in downhill skiing. One such variation involves the elimination of one ski altogether. In utilizing just a single ski, provision must be made for placing both feet on the ski while affording the skier some degree of control and, more importantly, safety. Further, the equipment must be designed to permit the user the ability not only to keep both feet in place while skiing, but also to be able to get on and off the ski, start and stop, all while maintaining his or her balance.

The prior art schemes by and large involve the placement of two identical bindings placed on a single ski. While safety bindings permit the user to quickly remove a ski boot, it is difficult to balance oneself on such equipment.

OBJECTS OF THE INVENTION

It is an object of the invention to provide a single ski apparatus which affords the user improved balancing capability.

It is a further object of the invention to provide a single ski apparatus which affords the user improved control performance.

It is a further object of the invention to provide a single ski apparatus that is safe to use.

SUMMARY OF THE INVENTION

These objects as well as others not enumerated here are achieved by the invention by the provision of an elevated ski-binding-assembly, which, at its top, is provided with a platform. To the structure, at its bottom, is rigidly attachable a single ski of conventional construction, and of conventional full length. Atop the platform, a miniski or slide plate is removably supported. The platform top supports plural ski-bindings, each one of the separated two-piece (toe-piece, heel-piece; or front-piece, rear-piece) type. The first such ski-binding is of conventional automatic-ejection or automatic-release type, but it is attached to the platform top, rather than to its conventionally intended device, namely a ski. The first ski-binding accepts one of the skier's boots; the boot and skier's foot is removable from the binding at the will of the skier who need merely overcome the restraint of the ejection mechanism.

The second ski-binding is unique to the present invention, in that it receives, removably so the miniski The second ski-binding is positioned side-by-side to the first, and is shaped so as to conform with the front and rear ends or tips of the miniski. Several variations or embodiments of the second ski-binding are disclosed; in each of these, the mini-ski is readily removable at the will of the skier, who needs to overcome merely the restraint of a spring mechanism in one embodiment, and no restraint at all in another embodiment.

More than that, whether the mini-ski be within, or out of the second ski-binding, at will the skier is able to lift ski-boot and foot out of the miniski. This is because the miniski supports a third ski-binding, which receives, removably so, that latter ski-boot. The third ski-binding is, per se, of conventional construction. Thus, the skier at will is able to remove both boots, and both feet, from all ski-apparatus, and use the ski-boots as walking shoes.

As a further development or variation of the invention, the toe-piece of the second ski-binding is attached to a swivel mechanism which in turn is supported for swivel movement, by and atop the platform. The swivel mechanism, per se, is the toe-piece of still another conventional ski-binding of the automatic release or automatic ejection type. The swivel mechanism, as an additional safety feature, serves to automatically eject the miniski.

BRIEF DESCRIPTION OF THE DRAWINGS

A more complete understanding of the present invention, as well as other objects and advantages thereof not enumerated, will become apparent upon consideration of the following detailed description, especially when considered in light of the accompanying drawings wherein.

Figure 1:
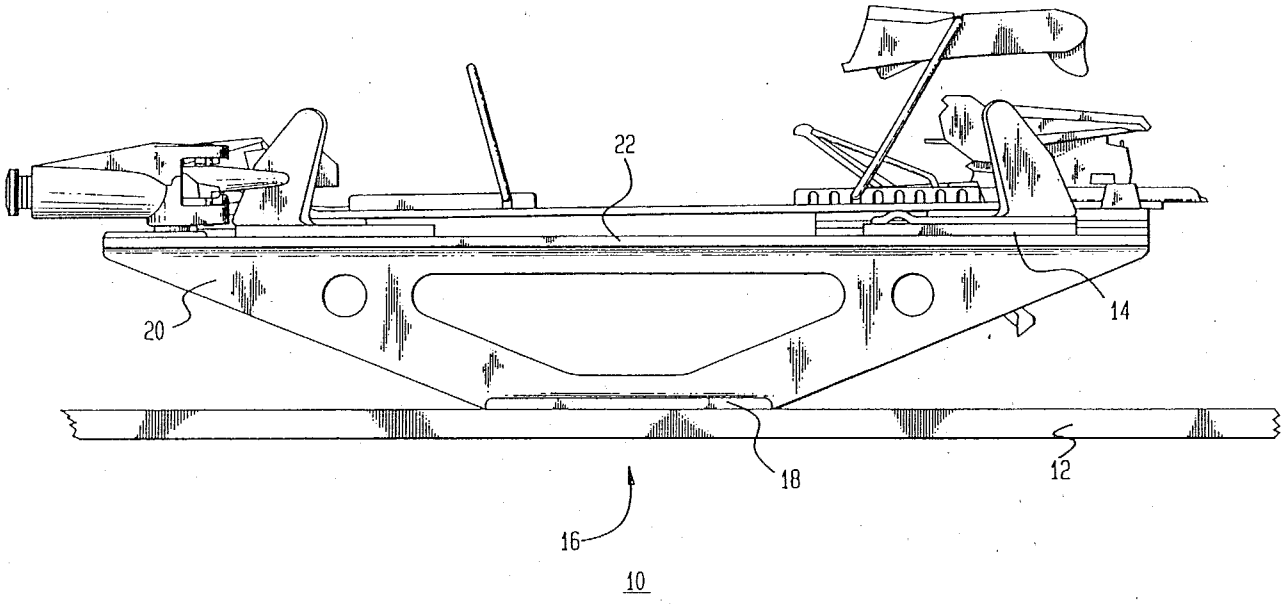
FIG. 1 is an elevation view of the invention.
Figure 2:
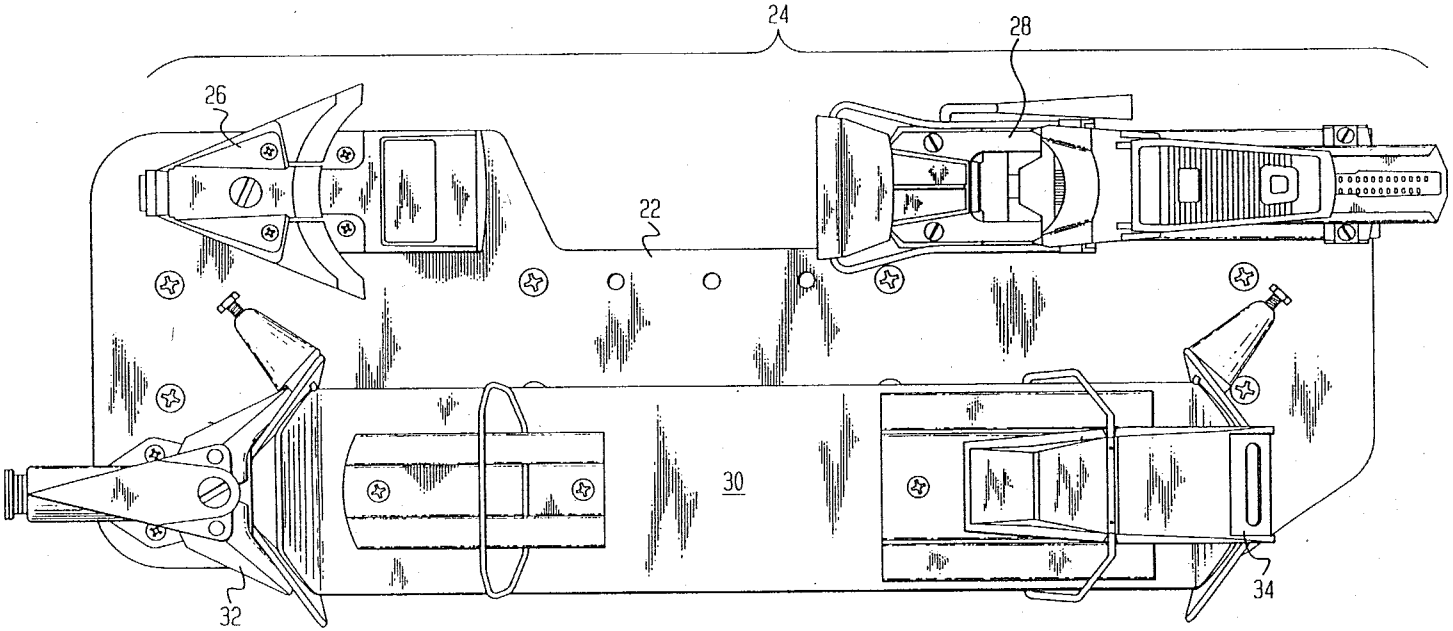
FIG. 2 is a top view of the binding assembly structure, depicting its platform.
Figure 3:
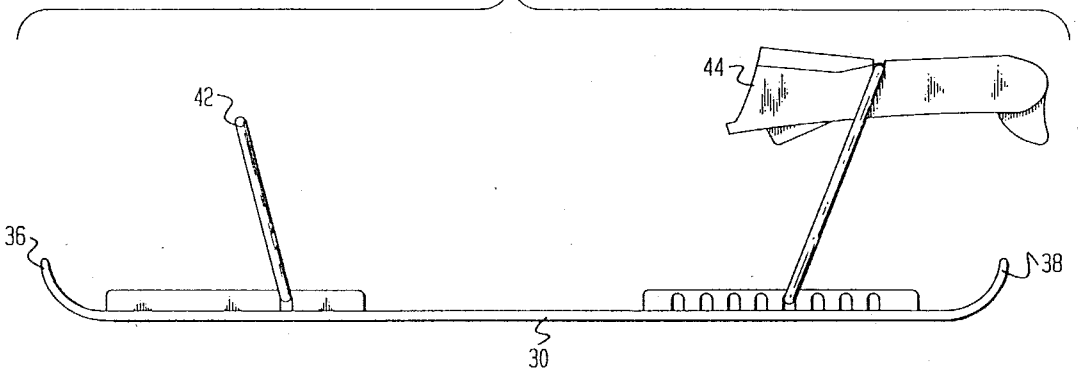
FIG. 3 is an elevation view of the slide plate or miniski.
Figure 5:
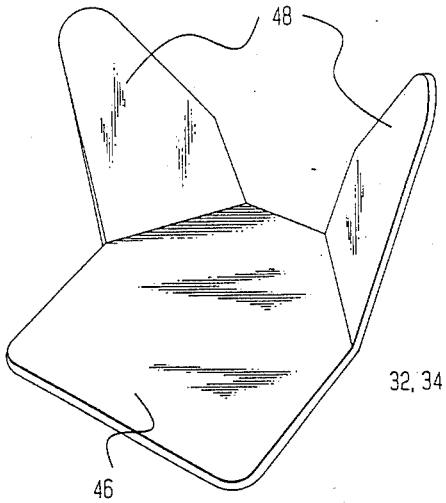
FIG. 5 is a perspective view of a shoe element (toe piece or heel-piece of the second ski-binding) according to the invention.
Figure 6:
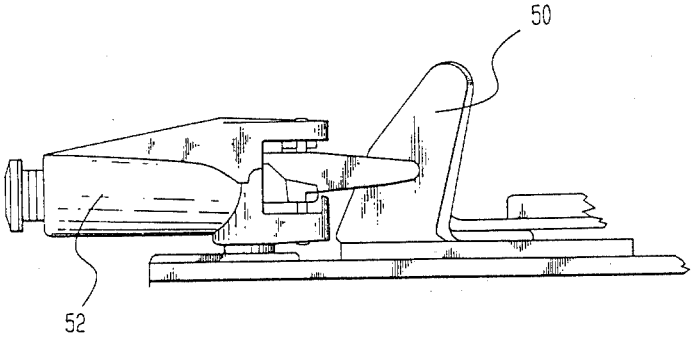
FIG. 6 is an elevation view of a safety swivel shoe or swivel mechanism.
Figure 7:
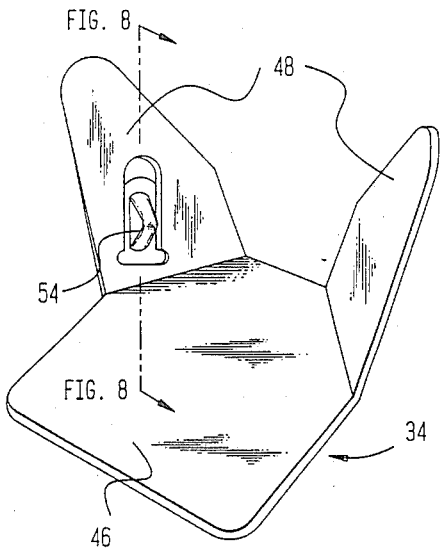
FIG. 7 is a perspective view of a shoe element (toe-piece or heel-piece of the second ski-binding) according to the invention similar to that of FIG. 5, but adding to it a bullet retainer pin element.
Figure 8:
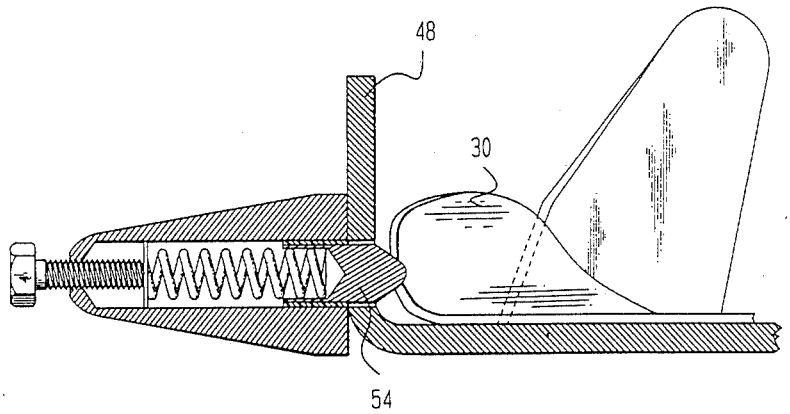
FIG. 8 is a cross-sectional view of the bullet retainer pin element.

Further to the just given drawing listing, FIGS. 3/4 are intended to be incorporated in several variations to be described, and are necessarily incorporated in the embodiment actually illustrated in FIGS. 1 and 2. That illustrated embodiment further incorporates the in FIG. 7/FIG. 8 illustrated version of shoe element with bullet retainer, and the in FIG. 6 illustrated safety swivel shoe. The FIG. 5 illustrated version of the shoe element may be utilized in the FIGS. 1 and 2 embodiment; the in FIG. 7/FIG. 8 illustrated shoe element is a version more advanced than that of FIG. 5.

DETAILED DESCRIPTION OF THE INVENTION

The structure of the single-ski/miniski apparatus can be best explained by reference to FIG. 1. The ski binding is designated generally by reference numeral 10. A conventional Alpine ski 12 forms the base for the structure 10. A binding assembly structure 14 is positioned on the ski 12 at the longitudinal center 16 of the ski 12. The structural elements of the binding assembly 14 are visible in FIG. 1: a base plate 18, an elevation strut 20, and a platform 22. The binding assembly 14 is attached to the ski 12 at the base plate 18. The elevation strut 20 serves as a support for the platform 22.

The platform 22 is shown in a top view in FIG. 2. A conventional binding 24 is positioned on one side of the platform 22. It has a toe engagement portion 26 and a heel engagement portion 28. This hardware is available off-the-shelf at ski supply shops. The ski-binding 24 is the first ski-binding in the meaning of the specification introduction.

A slide plate on miniski 30, resting in between two shoe elements 32 and 34, respectively, is located adjacent the conventional binding 24 on the platform 22. The shoe elements 32 and 34 constitute the second ski-binding; they are spaced apart a sufficient distance to permit the slide plate 30 to be inserted and removed with any upward, forward, or backward motion. This assumes that the FIG. 5 version of shoe elements 32, 34 appears in FIG. 2. Actually, FIG. 2 depicts the FIG. 7/FIG. 8 version, which merely impose a slight spring-like restraint to ready removal.

Figure 4:
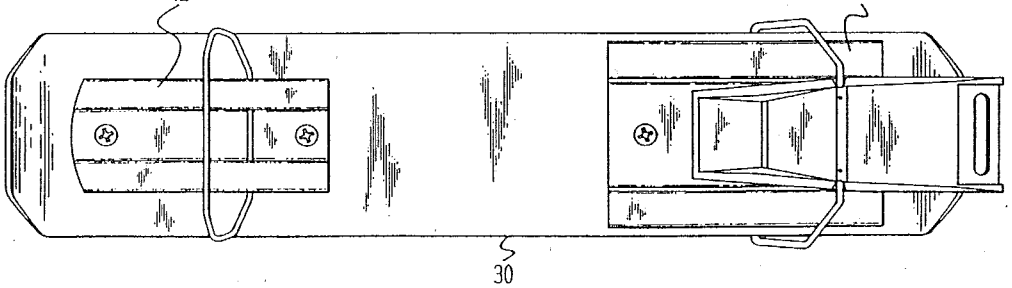
FIG. 4 is a top view of the slide plate or miniski.

The slide plate 30 is illustrated in an elevation view in FIG. 3. The slide plate 30 has a toe end 36 and a heel end 38. As can be seen in FIG. 3, the toe end 36 and the heel end 38 are turned slightly upward. Further, the slide plate 30 has an adjustable ski boot binding 40. The adjustable ski boot binding 40 constitutes the third ski-binding; it consists of a toe engagement portion 42 and a heel engagement portion 44. The slide plate 30 is again illustrated in a top view in FIG. 4.

A shoe element 32, 34 is illustrated in a perspective view in FIG. 5. A base 46 functions as a mounting surface for the shoe element 32, 34 and is placed on the platform 22 of the binding assembly 14. Fingers 48 rise upwardly from the base 46 of the shoe element 32, 34.

A variation of the shoe element 32, 34 is illustrated in FIG. 6. A shoe element 50 is shown attached to a swivel release binding 52. A further modification of the shoe element 32, 34 is the inclusion of a bullet retainer pin element 54 as illustrated in FIGS. 7 and 8. Ideally, the shoe element 50 illustrated in FIG. 6 would serve to engage the toe end 36 of the slide plate 30 and a second shoe element 34 having the bullet retainer pin element 54 would engage the heel end 38 of the slide plate 30. The locking strength of the pin 59 would depend on the geometry of the pin and the strength of the spring. The bullet retainer pin element 54 may be provided on both the toe shoe element 32 and the heel shoe element 34.

The use of the ski binding 10 is fairly straightforward for those skiers having at least some skiing experience. The conventional binding 24 requires no explanation; it is here that the skier's boot (not shown) is first engaged. The slide plate 30 functions as a mini-ski and allows one to retain his or her balance before pushing off or when one has stopped. The other boot (not shown) is removably inserted into the slide plate 30 using the toe engagement portion 32 and the heel engagement portion 44 of the adjustable ski boot binding 40. Before the skier pushes off, the foot engaged in the slide plate 30 is lifted and maneuvered until the slide plate 30 is inserted between the shoe element 32 and the shoe element 34. At any time, the skier can remove the slide plate 30 by lifting it out and away from the shoe elements 32 and 34.

Release performance similar to that of a conventional binding can be obtained with the slide plate 30 by using the shoe element 50 in combination with a swivel release 52, as illustrated in FIG. 6, for binding the toe end 36 of the slide plate 30. Furthermore, for more advanced skiers, a bullet retainer pin elements 54 can be provided in a finger 48 of the shoe elements 32 and 34 as illustrated in FIGS. 2 and 7.

In FIG. 2, the conventional binding 24 is shown on one side of the platform 22 with the slide plate or miniski 30 on the other. Obviously, these may be interchanged. Also, it is not necessary that the bindings be placed side-by-side. Tandem or offset arrangements are also possible.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed:

1. For use with a single ski, a ski apparatus, comprising an elevated ski-binding assembly structure which is provided with a base plate for rigid attachment to the single ski and an elevated platform, and further comprising the following which are situated atop the platform:

a first ski-binding having separated toe and heel pieces which are mounted on the platform for automatic release action, and serving to receive the first boot of a skier;

a miniski having upwardly curved front and rear end portions;

a second ski-binding being situated side-by-side to the first ski binding, and having nest-like toe and heel pieces which are mounted on the platform and are separated from one another by the length of the miniski receivable therebetween, the tip of the front end portion of the miniski being nested within the toe piece of the second ski-binding and the tip of the rear end portion of the miniski being nested within the heel piece of the second ski-binding, the arrangement being such that the toe and heel pieces of the second ski binding confine the miniski longitudinally while permitting relatively free vertical and lateral insertion and withdrawal movement, of the miniski relative to the second ski-binding, and a third ski-binding comprising separated toe and heel pieces which are mounted on the miniski for releasably securing the second boot of the skier to the miniski, whereby the skier, at will, may insert into or remove from the ski apparatus, either or both boots, and further, the miniski with the second boot retained therein.

2. Apparatus as claimed in claim 1 further comprising a swivel mechanism mounted on the platform for swivel movement thereon, the mechanism being of the automatic-release-type, the toe piece of the second ski-binding being attached to the swivel mechanism for in-unison movement therewith, whereby when the mechanism is activated sufficiently, the miniski will be given rotary movement in the horizontal plane, and will be ejected from the second binding.

3. Apparatus as claimed in claim 2 wherein the second binding's toe and heel pieces are similarly shaped, but are emplaced on the platform in symmetrical, opposed disposition, each piece being provided with a planar base piece whose defining plane generally extends on and along the plane of the platform, and in the same longitudinal direction as that of the miniski, the base pieces serving to support the planar parts of the ends of the miniski, each base piece terminating in a pair of laterally separated, and obliquely upward pointing finger portions which bear against the respective upwardly curved end or tip portion of the miniski, and thereby restrain longitudinal movement of the miniski at the level of the platform, while relatively readily permitting vertical bodily movement thereof.

4. Apparatus as claimed in claim 3, wherein for each of the second binding's toe and heel pieces, its interior one of the obliquely upwardly extending finger portions: (a) is provided with a through-aperture situated somewhat above the miniski, and (b) has secured to it a structure which has bullet-like appearance, and which internally contains a spring and a pin loaded by the spring, the pin extending through the aperture to above the miniski but retractably so against the action of the spring, whereby to offer some restraint to the vertical movement of the miniski.

5. Apparatus as claimed in claim 3, wherein the third ski-binding's toe and heel pieces are each generally in the shape of a solid-wire-square-loop, oriented in the width direction of the miniski, mounted to the miniski for hinged motion about an axis extending in that width direction, and being adjustably positionable fore and aft along the longtudinal direction of the miniski.

6. Apparatus as claimed in claim 3, wherein the third ski-binding's toe and heel pieces are each generally in the shape of a solid-wire-square-loop, oriented in the width direction of the miniski, mounted to the miniski for hinged motion about an axis extending in that width direction, and being adjustably positionable fore and aft along the longtudinal direction of the miniski.

7. Single ski apparatus as claimed in claim 2, wherein there is rigidly attached to the aforesaid base plate, the aforesaid single ski.

8. Apparatus as claimed in claim 1 wherein the second binding's toe and heel pieces are similarly shaped, but are emplaced on the platform in symmetrical, opposed disposition, each piece being provided with a planar base piece whose defining plane generally extends on and along the plane of the platform, and in the same longitudinal direction as that of the miniski, the base pieces serving to support the planar parts of the ends of the miniski, each base piece terminating in a pair of laterally separated, and obliquely upward pointing finger portions which bear against the respective upwardly curved end or tip portion of the miniski, and thereby restrain longitudinal movement of the miniski at the level of the platform, while relatively readily permitting vertical bodily movement thereof.

9. Apparatus as claimed in claim 7, wherein the third ski-binding's toe and heel pieces are each generally in the shape of a solid-wire-square-loop, oriented in the width direction of the miniski, mounted to the miniski for hinged motion about an axis extending in that width direction, and being adjustably positionable fore and aft along the longtudinal direction of the miniski.

10. Single ski apparatus as claimed in claim 8, wherein there is rigidly attached to the aforesaid base plate, the aforesaid single ski.

11. Apparatus as claimed in claim 1, wherein the third ski-binding's toe and heel pieces are each generally in the shape of a solid-wire-square-loop, oriented in the width direction of the miniski, mounted to the miniski for hinged motion about an axis extending in that width direction, and being adjustably positionable fore and aft along the longtudinal direction of the miniski.

12. Single ski apparatus as claimed in claim 11, wherein there is rigidly attached to the aforesaid base plate, the aforesaid single ski.

13. Single ski apparatus as claimed in claim 1, wherein there is rigidly attached to the aforesaid base plate, the aforesaid single ski.

* * * * *